US005368006A

United States Patent [19]

McPherson

[11] Patent Number: 5,368,006

[45] Date of Patent: Nov. 29, 1994

[54] DUAL-FEED SINGLE-CAM COMPOUND BOW

[75] Inventor: Mathew A. McPherson, Austin, Minn.

[73] Assignee: Bear Archery, Inc., Gainesville, Fla.

[21] Appl. No.: 875,748

[22] Filed: Apr. 28, 1992

[51] Int. Cl.[5] ..... F41B 5/10

[52] U.S. Cl. ..... 124/25.6; 124/900

[58] Field of Search ..... 124/23.1, 24.1, 25.6, 124/86, 88, 900

[56] References Cited

U.S. PATENT DOCUMENTS

| | | | |
|---|---|---|---|
| 3,486,495 | 12/1969 | Allen | 124/25.6 |
| 3,841,295 | 10/1974 | Hunter . | |
| 3,890,951 | 6/1975 | Jennings et al. . | |
| 3,958,551 | 5/1976 | Ketchum . | |
| 3,987,777 | 10/1976 | Darlington | 124/25.6 |
| 4,060,066 | 11/1977 | Kudlacek | 124/25.6 |
| 4,079,723 | 3/1978 | Darlington | 124/25.6 |
| 4,103,667 | 8/1978 | Shepley . | |
| 4,112,909 | 9/1978 | Caldwell | 124/90 X |
| 4,178,905 | 12/1979 | Groner . | |
| 4,300,521 | 11/1981 | Schmitt . | |
| 4,365,611 | 12/1982 | Nishioka . | |
| 4,372,285 | 2/1983 | Simonds et al. | 124/90 |
| 4,440,142 | 4/1984 | Simonds . | |
| 4,512,326 | 4/1985 | Jarrett | 124/25.6 |
| 4,562,824 | 1/1986 | Jennings . | |
| 4,909,231 | 3/1990 | Larson . | |
| 5,054,463 | 10/1991 | Colley et al. | 124/25.6 |

OTHER PUBLICATIONS

Patent application of Larry D. Miller for "Archery Bow Assembly", date and Ser. No. unknown.

Martin DynaBo-One Step Beyond, "Archery World", Sep. 1976, pp. 28, 29, 74.

Graham Take-Down DynaBo, "Archery World," Jun./Jul. 1980.

*Primary Examiner*—Randolph A. Reese
*Assistant Examiner*—John Ricci
*Attorney, Agent, or Firm*—Malina & Wolson

[57] ABSTRACT

A cam is eccentrically journaled at one end of a compound archery bow and a pulley is journaled at the other end of the bow. A cable passes around the pulley to form a bowstring section and a second cable section, both sections forming a dual feed single cam compound bow. The amount of feed out to both ends of the bowstring is approximately the same. One embodiment of the cam provides a large radius cam groove and a smaller radius cam groove which are designed to synchronize the rate of cable feed out at both ends of the bowstring section during the drawing operation. An anchor cable is provided to tie the two limbs of the bow together during the flexing of the bow.

5 Claims, 2 Drawing Sheets

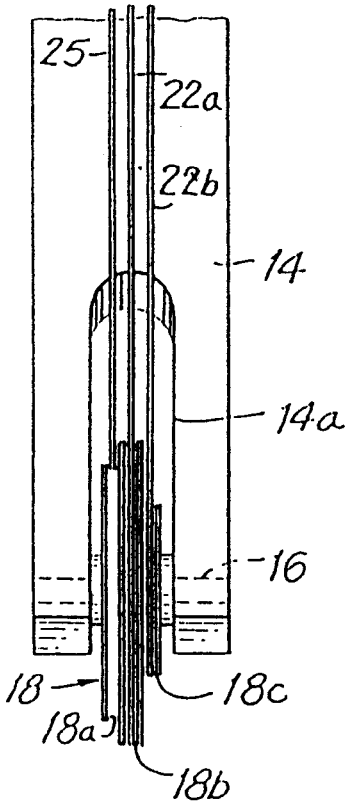
FIG. 4
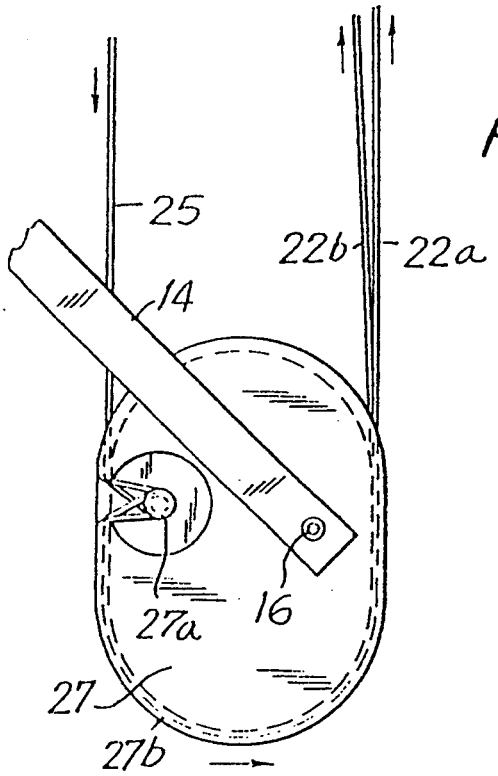
FIG. 5
FIG. 6
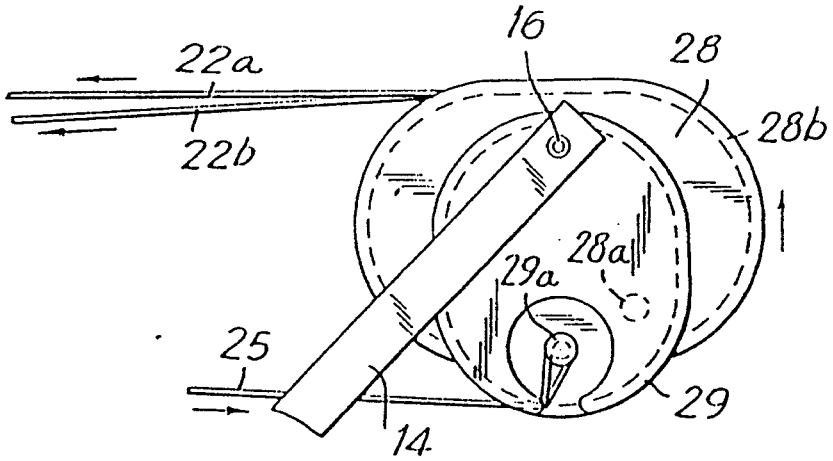

DUAL-FEED SINGLE-CAM COMPOUND BOW

BACKGROUND OF THE INVENTION

In the past, compound bows have used two cams, respectively mounted on the limb tips of opposite ends of the bow, to provide the means to store more energy in the draw cycle and to reduce the holding force at full draw. These eccentric cam elements must be accurately synchronized with respect to the radii of eccentricity so that the rate of feed-out will be approximately equal at both ends of the bows. This requires synchronized indexing of the two cams when the cams and cable elements are being assembled. Such a double cam compound bow construction is illustrated by the bows disclosed in the following prior art patents.

| U.S. Pat. No. | Issued To | Date Issued |
|---|---|---|
| 3,486,495 | Allen | Dec. 30, 1969 |
| 3,890,951 | Jennings, et al | June 24, 1975 |
| 4,060,066 | Kudlacek | Nov. 29, 1977 |
| 4,079,723 | Darlington | March 21, 1978 |
| 4,112,909 | Caldwell | Sept. 12, 1978 |
| 4,300,521 | Schmitt | Nov. 17, 1981 |

The early compound bows utilized cams consisting of eccentrically mounted circular shaped elements. As the desire for more stored energy and greater arrow velocities developed, special shaped cam elements were designed to provide these characteristics. These shaped cam elements, like the circular shaped elements, were mounted on the limb tips. It is well known in the art that to obtain the best bow performance, the cam elements at each end of the bow should be properly synchronized with each other. Patents disclosing various means to accomplish proper cam synchronization include the following:

| U.S. Pat. No. | Issued To | Date Issued |
|---|---|---|
| 3,841,295 | Hunter | Oct. 15, 1974 |
| 3,958,551 | Ketchum | May 25, 1976 |
| 4,103,667 | Shepley, Jr. | Aug. 1, 1978 |
| 4,178,965 | Groner | Dec. 18, 1979 |

The more modern compound bows have reverted back to the more simplistic design of the original U.S. Pat. No. 3,486,495 Allen patent, but the requirement for cam synchronization is still present as noted, for example, by the teachings of the following patents:

| U.S. Pat. No. | Issued To | Date Issued |
|---|---|---|
| 4,372,285 | Simonds | Feb. 8, 1983 |
| 4,440,142 | Simonds | Apr. 3, 1984 |
| 4,909,231 | Larson | Mar. 20, 1990 |

It is obvious, of course, that the use of a single cam avoids the problem of cam synchronization and, in fact, there are single cam bows known in the prior art. One such bow, popularly referred to as the "DynaBo" was invented by Len Subber. The original Dynabo design had one working limb located at the upper end of the bow handle. A single cam element was mounted on a rigid pylon at the lower end of the bow. The single cam element functioned in the same manner as the cam elements on the previously mentioned two cam bows. As the Dynabo was drawn, one track of the cam element payed out line to the bowstring which was fixed to the upper limb tip and the other track on the cam element acted as a take-up reel for a second line that was also anchored at the tip of the upper working limb.

Since there was only a single cam element, there was not a synchronization problem between two cams. There was, however, a problem in synchronizing the rate that the cam fed out cables to the bowstring at the lower end of the bow and the rate that the flexing of the upper limb fed out cable to the bowstring at the upper end as the bow was drawn. The result was a rather unpleasant feel to the bow as it was drawn and there was a drastic movement of the nocking point and the rear end of the arrow as the bow was drawn and released. This, in turn, made it very difficult to achieve good arrow flight from the bow under normal conditions. An early version of the DynaBo was described in the September 1976 edition of "Archery World" beginning at page 28.

The Dynabo single cam concept was offered in at least three different versions from as many manufacturers during the 1970's, and at least one manufacturer, Graham's Custom Bows, employed the Dynabo concept, with two working limbs. A description of the Graham bow is contained in the June/July edition of "Archery World" magazine. The Dynabo bow, however, never did become an acceptable alternative to the two cam bows and, in fact, appears to have lost whatever popularity it had achieved by the late 1970's.

Another known prior art device that had the capability of providing a solution to the previously mentioned problems of cam synchronization and synchronized bow string feed out (the latter being desirable to enable the nock end of the arrow to travel in a smooth, consistent path upon draw and release of the arrow) is set forth in U.S. Pat. No. 4,562,824 issued to Jennings. This patent teaches the use of a single multiple grooved cam mounted on a pylon attached to the bow handle. The cam had one string track feeding cable attached to an idler pulley mounted in the limb tip at one end of the bow and a second track feeding line to a second idler pulley mounted in the second limb tip at the other end of the bow. The cam also has two additional tracks, each of which take up line while the string tracks feed out line to the bow string. One take-up track is taking up a line which is anchored at one limb tip while the other take-up track is taking up a line which is anchored at the opposite limb tip. Thus, the '824 patent teaches a highly complicated system, as compared to the present invention, that is composed of considerably more parts resulting in a compound bow having greater mass weight than the more conventional two cam compound bow.

A single cam bow developed by Larry D. Miller in the late 1970's or early 1980's was the subject of a U.S. patent application titled "Archery Bow Assembly" (hereinafter referred to as the "Miller application"). The Miller application discloses the use of a single pulley, having two grooves thereon for feeding out line to the bow string. The primary groove is circular and concentric with the axle of the circular pulley. The secondary groove, also circular, may be slightly eccentric for the purpose of maintaining the nocking point of the bowstring perpendicular to the handle section of the bow. A third eccentric groove carries a take-up cable to provide the entire means of compounding (i.e. achieving the desired reduction in holding weight at full draw and storage of energy).

The Miller application, the serial number of which is not known, may be considered material to the examination of the subject application.

SUMMARY OF THE INVENTION

The present invention embodies a compound bow construction which provides only a single drop-off cam mounted on one end of the bow to produce the desired synchronized feed out of cable to the upper and lower ends of the bowstring and eliminates the need for two drop-off cams and the attendant cam synchronization problem.

The single cam unit is eccentrically journaled at one limb end of the bow and a pulley is journaled at the other limb end of the bow. A cable passes around the pulley to form a bowstring section and a second cable section, both sections forming a dual-feed single-cam compound bow. The amount of feed-out to both ends of the bowstring must of course be approximately the same. One form of the cam member provides a large periphery cam groove and a small periphery cam groove which are designed to synchronize the rate of cable feed-out at both ends of the bowstring during the drawing operation. Other forms of the invention are also disclosed.

An anchor cable is also provided to tie the two limbs of the bow together during the flexing of the bow. In the form shown in FIGS. 1 through 5, this anchor cable is fixed at one end to the axle of the concentric pulley and extends across to a take-up cam to synchronize the flexing action of the bow limbs.

DETAILED DESCRIPTION OF THE DRAWINGS

FIG. 4 is a top plan view of the cam wheel shown in FIGS. 2 and 3 with segments of the cables trained in the grooves thereof;

FIG. 5 is a side elevational view of an alternate form of cam embodying this invention;

FIG. 6 is a view of another form of cam embodying this invention;

DETAILED DESCRIPTION OF THE INVENTION

In the accompanying drawings, an archery bow assembly B is illustrated which includes a central handle portion 10, having a pair of limbs 12 and 14, connected at their inner ends in fixed relation to the handle portion 10. The limbs 12 and 14 provide the desired resistance to bending which determines the draw weight of the bow and the force with which the arrow is discharged.

Figure 1:
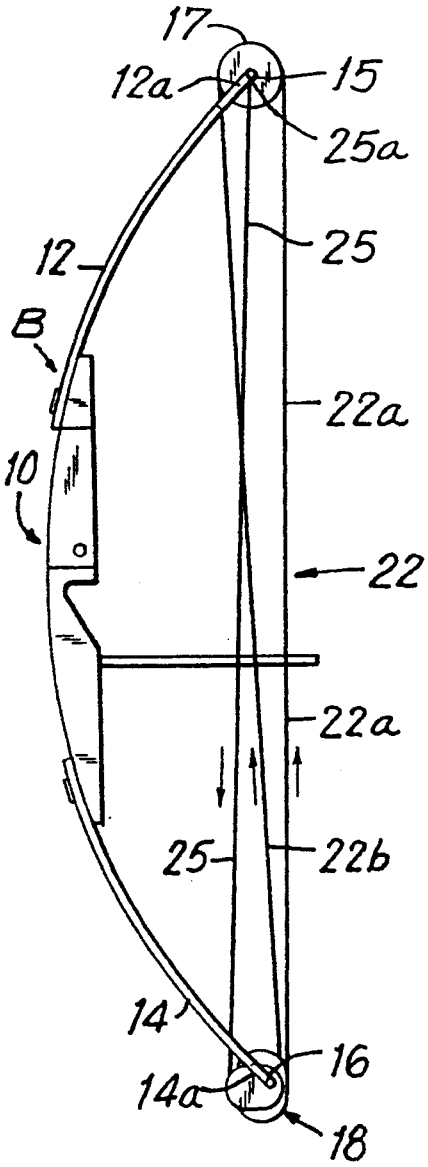
FIG. 1 is a side elevational view showing one form of the invention.
Figure 2:
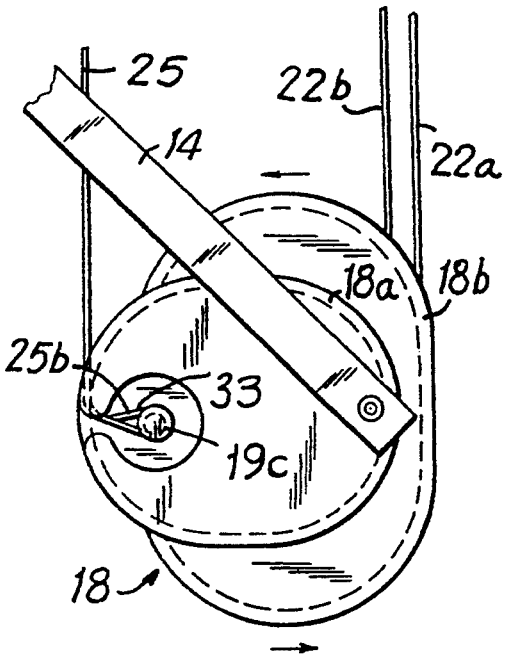
FIGS. 2 and 3 are opposite side views of the cam shown generally in FIG. 1.
Figure 3:
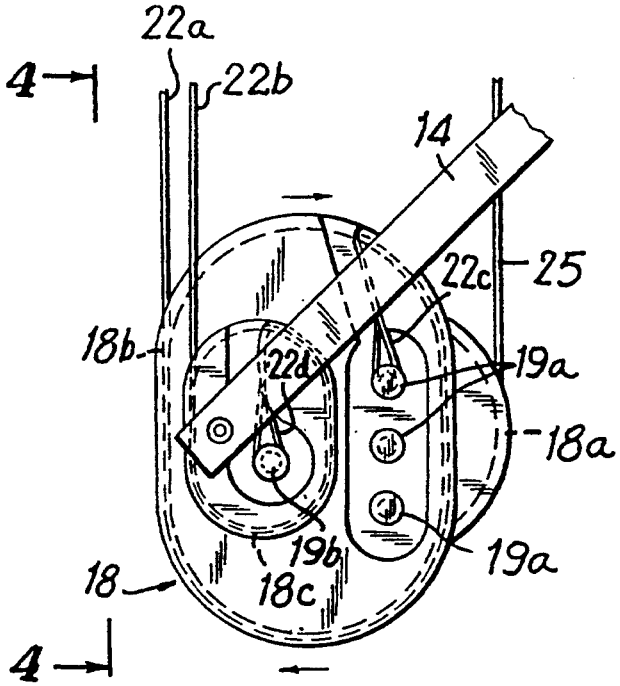

As shown in FIGS. 1–4, the outer ends of the bow limbs provide wheel receiving slots which define wheel mounting forks, respectively designated by the numbers **12*a* and 14*a*, for mounting axle pins 15 and 16. A pulley 17 is concentrically mounted on the axle pin 15. In this form of the invention, the pulley 17 is provided with a single groove. As shown in FIGS. 2–4, one form of eccentric cam 18 is mounted on an axle pin 16 and, in the form shown in FIGS. 2–4, has three eccentrically oriented grooves, 18*a*, 18*b*, and 18*c*** formed in the outer periphery thereof to provide three separate cable groove paths.

A cable 22 has a medial portion trained around concentric pulley wheel 17 to form a main cable section or bow-string **22*a* and a secondary or return section 22*b*, both of which extend across the bow to the cam 18. The end portions 22*c* and 22*d* of the two sections 22*a* and 22*b* are respectively received in grooves 18*b* and 18*c* of the cam 18. The ends 22*c* and 22*d* of the sections 22*a* and 22*b* are anchored to the cam 18 as by the cable anchor pins 19*a* and 19*b* fixed to said cam 18, as best shown in FIG. 2. In the form shown, three (3) anchor pins 19*a* are provided to permit adjustment of the effective length of cable 22 and bowstring 22*a***.

An anchor cable 25 is anchored at one end **25*a* to the axle pin 15 and passes around the cam groove 18*a* on the take-up side of the cam 18. The other end 25*b* of cable 25 is attached to anchor pin 19*c* and positively ties the two bow limbs 12 and 14 together to form a direct connection between the limbs 12 and 14**.

Alternative forms of the invention are illustrated in FIGS. 5–6, but in each case the dual-feed-out cable sections **22*a* and 22*b* operate and extend outwardly from a drop-off cam unit mounted on the limb 14 of the bow in the same manner as described for the form shown in FIGS. 1–4. In FIG. 5, an eccentric drop-off cam 27 is illustrated having the feed-out sections 22*a* and 22*b* extending outwardly therefrom toward the concentric pulley 17. The cam 27 has a single groove extending all around its complete periphery with the cable sections 22*a* and 22*b* received in the groove. The ends of the cable sections are anchored to an anchor pin 27*a* fixed to one side of the cam 27. The anchor cable 25 is also securely anchored to the anchor pin 27*a*, as shown in FIG. 5. Another alternative form of the let-off cam is illustrated in FIG. 6 which embodies a eccentric drop-off cam 28 having a single groove 28*b* thereon wherein cable sections 22*a* and 22*b* are received. A suitable anchor pin 28*a* is provided on the back side of the cam 28 as shown by dotted lines in FIG. 6 and both ends of cable sections 22*a* and 22*b* are secured thereto in the same manner as previously described. The anchor cable 25 is trained in groove 29 of cam 28 and secured to the anchor pin 29*a* of cam 28. Cam 28 is eccentrically mounted on an axle pin 16 connected to the limb 14** of the bow.

What is claimed is:

1. A dual-feed single-cam compound bow comprising a pair of flexible resilient bow limbs forming first and second outer bow limb ends with a handle connecting inner ends thereof, a single drop-off cam journaled at the first outer bow limb end and having eccentric peripheral groove portions, a pulley concentrically journaled at the second outer bow limb end and having peripheral concentric groove portions, an elongated cable, having an intermediate portion trained around the concentric pulley to form two cable sections extending between the pulley and the cam, one section forming a bowstring having feed-out end portions at both ends thereof and the other section forming a take-up portion at the pulley end thereof and a feed-out portion at the cam end thereof, both received in eccentric peripheral groove portions of the cam in a manner to provide a pair of feed-out sections extending from the cam toward the pulley, the ends of the two cable sections being positively anchored to the cam to produce the desired drop-off rotation of the cam when the bowstring is drawn, and an anchor cable extending between the two limbs with one end thereof fixed to the second bow limb end and the other anchor cable end fixed to the cam and trained in a take-up groove portion of the cam to produce controlled flexing of the bow limbs during the drawing of the bowstring.

2. The structure set forth in claim 1 and the drop-off cam having three peripheral groove portions, each having different radii of eccentricity to maintain the desired tension in the cable during the drawing of the bow while controlling the drop-off of the force required to draw and retain the bowstring in drawn position.

3. The structure set forth in claim 2 wherein said cam is provided with a single groove and the feed-out sections of the cable being received in the eccentric peripheral portion of the groove and the anchor cable being received in one of said three peripheral groove portions with the ends of all three cable being positively anchored to the drop-off cam.

4. The structure set forth in claim 3 and a common anchor member fixed to said cam in general alignment with the cam groove, and all of the ends of the cables being anchored on the common anchor.

5. The structure set forth in claim 1 wherein the cam includes a pair of peripheral eccentric grooves having different paths of eccentricity.

* * * * *